US006875293B2

(12) United States Patent
Peker

(10) Patent No.: US 6,875,293 B2
(45) Date of Patent: Apr. 5, 2005

(54) METHOD OF FORMING MOLDED ARTICLES OF AMORPHOUS ALLOY WITH HIGH ELASTIC LIMIT

(75) Inventor: Atakan Peker, Aliso Viejo, CA (US)

(73) Assignee: LiquidMetal Technologies Inc, Lake Forest, CA (US)

( * ) Notice: Subject to any disclaimer, the term of this patent is extended or adjusted under 35 U.S.C. 154(b) by 0 days.

(21) Appl. No.: 10/236,792

(22) Filed: Sep. 6, 2002

(65) Prior Publication Data

US 2003/0047248 A1 Mar. 13, 2003

Related U.S. Application Data

(60) Provisional application No. 60/318,154, filed on Sep. 7, 2001.

(51) Int. Cl.[7] ..... C22C 45/00
(52) U.S. Cl. ..... 148/561
(58) Field of Search ..... 148/561, 403

(56) References Cited

U.S. PATENT DOCUMENTS

| | | | | |
|---|---|---|---|---|
| 5,032,196 | A | 7/1991 | Masumoto et al. | |
| 5,209,791 | A | 5/1993 | Masumoto et al. | |
| 5,288,344 | A | 2/1994 | Peker et al. | |
| 5,296,059 | A | 3/1994 | Masumoto et al. | |
| 5,306,463 | A | 4/1994 | Horimura | |
| 5,324,368 | A | 6/1994 | Masumoto et al. | |
| 5,368,659 | A | 11/1994 | Peker et al. | |
| 5,589,012 | A | 12/1996 | Hobby et al. | |
| 5,618,359 | A | 4/1997 | Lin et al. | |
| 5,735,975 | A | 4/1998 | Lin et al. | |
| 5,896,642 | A | 4/1999 | Peker et al. | |
| 5,950,704 | A | 9/1999 | Johnson et al. | |
| 6,027,586 | A | 2/2000 | Masumoto et al. | |
| 6,258,183 | B1 * | 7/2001 | Onuki et al. | 148/561 |
| 6,325,868 | B1 | 12/2001 | Kim et al. | |

FOREIGN PATENT DOCUMENTS

JP 2001303218 10/2001

OTHER PUBLICATIONS

Hays et al., "Microstructure Controlled Shear Band Pattern Formation and Enhanced Plasticity of Bulk Metallic Glasses Containing in Situ Formed Ductile Phase Dendrite Dispersions," *Physical Review Letters*, Mar. 27, 2000, pp. 2901–2904, vol. 84, No. 13, The American Physical Society.

Inoue et al., "Bulk Amorphous Alloys with High Mechanical Strength and Good Soft Magnetic Properties in Fe–TM–B (TM=IV–VIII Group Transition Metal) System," *App. Phys. Lett.*, Jul. 28, 1997, pp. 464–466, vol. 71, No. 4, American Institute of Physics.

Shen et al., "Bulk Glassy $Co_{43}Fe_{20}Ta_{5.5}B_{31.5}$Alloy with High Glass–Forming Ability and Good Soft Magnetic Properties," *Materials Transactions*, 2001, pp. 2136–2139, vol. 42, No. 10, Rapid Publication.

* cited by examiner

*Primary Examiner*—George Wyszomierski
(74) *Attorney, Agent, or Firm*—Christie, Parker & Hale, LLP

(57) ABSTRACT

A method for forming molded articles of bulk-solidifying amorphous alloys around the glass transition range, which preserves the high elastic limit of the bulk solidifying amorphous alloy upon the completion of molding process is provided. The method comprising providing a feedstock of bulk solidifying amorphous alloy, then molding the amorphous alloy feedstock around the glass transition range to form a molded article according to the current invention which retains an elastic limit of at least 1.2%.

25 Claims, 8 Drawing Sheets

Preferred Method

METHOD OF FORMING MOLDED ARTICLES OF AMORPHOUS ALLOY WITH HIGH ELASTIC LIMIT

CROSS REFERENCE TO RELATED APPLICATIONS

This application claims priority on U.S. provisional application No. 60/318,154 filed on Sep. 7, 2001, the content of which is incorporated herein by reference.

FIELD OF THE INVENTION

This invention is directed generally to a method of forming molded articles of bulk-solidifying amorphous alloys around the glass transition range, and more specifically to a method of forming molded articles of bulk-solidifying amorphous alloys which also preserves the high elastic limit of the bulk solidifying amorphous alloy upon the completion of molding process.

BACKGROUND OF THE INVENTION

Amorphous alloys, when properly formed from the molten state at sufficiently fast cooling rates, have high elastic limits, typically in the range of from 1.8% to 2.2%. Further, these amorphous alloys may show substantial bending ductility of up to 100%, such as in the case of thin melt spun ribbons. In addition, amorphous alloys being capable of showing glass transition are further capable of forming a super-cooled liquid above the glass transition range and can be significantly deformed using very small applied forces (normally, 20 MPa or less).

Recently bulk-solidifying amorphous alloys have been discovered which can be cooled at cooling rates of about 500 K/sec or less from their molten state to form objects of 1.0 mm or more thickness with substantially amorphous atomic structure. These bulk-solidifying amorphous alloys are substantially thicker than conventional amorphous alloys, which have thicknesses of typically 0.020 mm, and which require cooling rates of $10^5$ K/sec or more. U.S. Pat. Nos. 5,288,344; 5,368,659; 5,618,359; and 5,735,975 (each incorporated by reference herein) disclose such families of bulk solidifying amorphous alloys. The discovery of bulk-solidifying amorphous alloys gives rise to a wide-variety of applications. As such, a practical and cost-effective method of forming bulk-solidifying amorphous alloys, such as molding around the glass transition range, is desired to allow for the use of these materials in designs requiring intricate precision shapes. It should be noted that substantial bending ductility (as much as 100%) is not necessarily essential for all applications of bulk-solidifying amorphous alloys—as they are designed to utilize elastic limit—although at least some percent of bending ductility is generally preferred.

U.S. Pat. Nos. 6,027,586; 5,950,704; 5,896,642; 5,324,368; and 5,306,463 (each incorporated by reference herein) disclose methods of forming molded articles of amorphous alloys exploiting their capability of showing a glass transition. However, it has been recently observed that amorphous alloys may lose their ductility when subjected to temperatures around the glass transition temperature. Indeed, a substantial portion of the high elastic limit of most bulk-solidifying amorphous alloy may easily be lost during these conventional forming processes, even though the amorphous material itself may substantially retain its amorphous structure. Beyond the loss of the elasticity of the final product, these methods may also lead to a loss of fracture toughness, which limits the ultimate strength levels attainable with the material. Indeed, the loss of high elastic limit becomes the norm rather than the exception utilizing conventional methods of forming molded articles of bulk solidifying amorphous alloys. Although this phenomenon has been attributed to a variety of factors, such as micro-crystallization and structural relaxation, a variety of thermally activated processes—such as spinodal decomposition and formation of nano-crystals—may also be at least partially responsible. U.S. Pat. Nos. 5,296,059 and 5,209,791 (each incorporated by reference herein) try to address the loss of substantial bending ductility and disclose methods of imparting ductility to amorphous alloys subjected to temperatures around the glass transition range. Despite these attempts, no prior art method of forming bulk-solidifying amorphous alloys adequately addresses the problem of lost ductility and high elastic limit.

For example, after practicing various molding process of bulk-solidifying amorphous alloys around the glass transition range, the elastic limit may become as small as 0.1% even though the alloys are deemed substantially amorphous by conventional methods such as X-ray diffraction. Moreover, X-ray diffraction techniques, commonly used to determine amorphous structure in prior art methods, prove to be insufficient for quick and cost-effective—if effective at all—detection of loss in elastic limit, although it shows substantially amorphous structure.

In essence, the prior art methods of forming molded articles of amorphous alloy do not generally preserve the high elastic limit of bulk-solidifying amorphous alloys after the forming and shaping process has been completed. Accordingly, a new and improved method of forming molded articles of bulk solidifying amorphous alloys is desired, which substantially preserves the high elastic limit upon completion of molding process.

SUMMARY OF INVENTION

The invention is directed to a method for forming molded articles of bulk-solidifying amorphous alloys around the glass transition range, which preserves the high elastic limit of the bulk solidifying amorphous alloy upon completion of molding process. The method generally comprising providing a feedstock of bulk solidifying amorphous alloy, then molding the amorphous alloy feedstock around the glass transition range to form a molded article according to the current invention which retains an elastic limit of at least 1.2%.

In another embodiment, the molded article retains an elastic limit of at least 1.8%, and more preferably an elastic limit of at least of 1.8% plus a bend ductility of at least 1.0%. Although any bulk-solidifying amorphous alloy may be utilized in the present invention, in a preferred embodiment the bulk-solidifying amorphous alloy has the capability of showing a glass transition and has an elastic limit of at least 1.5%. More preferably, the feedstock amorphous alloy has an elastic limit of at least 1.8%, and most preferably the feedstock amorphous alloy has an elastic limit of at least of 1.8% and a bend ductility of at least 1.0%. Further, the feedstock of bulk-solidifying amorphous alloy preferably has a ΔTsc (supercooled liquid region) of more than 30° C., and preferably a ΔTsc of more than 60° C., and still most preferably a ΔTsc of 90° C. or more.

In still another embodiment, the temperature of the molding step is limited such that when ΔTsc of the feedstock amorphous alloy is more than 90° C., then the Tmax is given by (Tsc+½ ΔTsc), and preferably is given by (Tsc+¼ ΔTsc), and most preferably is given by Tsc. When ΔTsc of the feedstock amorphous alloy is more than 60° C., then the Tmax is given by (Tsc+¼ ΔTsc), and preferably is given by (Tsc), and most preferably is given by Tg. When ΔTsc of the feedstock amorphous alloy is more than 30° C., then the Tmax is given by Tsc, and preferably is given by (Tg), and most preferably is given by Tg−30.

In yet another embodiment, the time of the molding step is limited such that for a given Tmax, t(T>Tsc) defines the maximum permissible time that can be spent above the Tsc during the molding process, and t(T>Tsc) (Pr.) defines the preferred maximum permissible time. Further, for a given Tmax, t(T>Tg) defines the maximum permissible time that can be spent above the Tg during the molding process, and t(T>Tg) (Pr.) defines the preferred maximum permissible time. In addition to above conditions, for a given Tmax, t(T>Tg−60) defines the maximum permissible time that can be spent above the temperature (Tg−60)° C. during the molding process, and t(T>Tg−60) (Pr.) defines the preferred maximum permissible time.

In still yet another embodiment, the shape of the thickness of the feedstock is preserved over at least 20% of the surface area of the feedstock blank upon the completion of forming operation. Preferably, the thickness of the feedstock blank is preserved over at least 50% of its surface area, and still more preferably the thickness of the feedstock is preserved over at least 70% of its surface area, and most preferably the thickness of the feedstock is preserved over at least 90% of its surface area. In this embodiment, the thickness of a feedstock blank is "preserved" when the thickness change is less than 10%, and preferably less than 5% and still more preferably less than 2% and most preferably the thickness remains substantially unchanged.

In still yet another embodiment the alloy composition and the time and temperature of molding is chosen based on the ratio ΔH1/ΔT1 compared to ΔHn/ΔTn. In such an embodiment, the preferred composition is that material with the highest ΔH1/ΔT1 compared to other crystallization steps. For example, in one embodiment a preferred alloy composition has **ΔH1/ΔT1>2.0*ΔH2/ΔT2, still more preferable is ΔH1/ΔT1>4.0*ΔH2/ΔT2. For these compositions more aggressive time and temperatures can be readily utilized in molding operations, i.e. t(T>Tsc) and Tmax rather than t(T>Tsc) (Pr.) and Tmax (Pr.). In contrast, for compositions where ΔH1/ΔT1<0.5*ΔH2/ΔT2**, more conservative time and temperatures are preferable i.e. t(T>Tsc) (Pr.) and Tmax (M. Pr.) rather than t(T>Tsc) and Tmax (Pr.).

In still yet another embodiment, the molding process is selected from the group consisting of blow molding, die-forming, and replication of surface features from a replicating die.

In still yet another embodiment, the alloy is selected from the family comprising $(Zr,Ti)_a(Ni,Cu,Fe)_b(Be,Al,Si,B)_c$, where a is in the range of from 30% to 75% of the total composition in atomic percentage, b is in the range of from 5% to 60% of the total composition in atomic percentage, and c is in the range of from 0% to 50% in total composition in atomic percentage. In still yet another embodiment, the alloys contains substantial amounts of other transition metals up to 20% of the total composition in atomic percentage, such as Nb, Cr, V, Co.

Suitable exemplary alloy families include: $(Zr,Ti)_a(Ni,Cu)_b(Be)_c$, wherein a is in the range of from 40% to 75% total composition in atomic percentage, b is in the range of from 5% to 50% total composition in atomic percentage, and c is in the range of from 5% to 50% total composition in atomic percentage; $(Zr,Ti)_a(Ni,Cu)_b(Be)_c$, wherein a is in the range of from 45% to 65% total composition in atomic percentage, b is in the range of from 10% to 40% total composition in atomic percentage, and c is in the range of from 5% to 35% total composition in atomic percentage, and the ratio of Ti/Zr is in the range of from 0 to 0.25; and $(Zr)_a(Ti,Nb)_b(Ni,Cu)_c(Al)_d$ wherein a is in the range of from 45% to 70% total composition in atomic percentage, b is in the range of from 0% to 10% total composition in atomic percentage, c is in the range of from 10% to 45% total composition in atomic percentage, and d is in the range of from 5% to 25% total composition in atomic percentage. One suitable exemplary alloy from the above family is $Zr_{47}Ti_8Ni_{10}Cu_{7.5}Be_{27.5}$.

In still yet another exemplary embodiment, the feedstock of the bulk-solidifying amorphous alloy is prepared by a casting process, including continuous casting and metal mold casting process, and the feedstock is formed into a blank shape selected from the group consisting of sheets, plates, bars, cylindrical rods, I-beams and pipes.

In still yet another embodiment the invention is directed to a method of determining the elastic limit of a molded article.

BRIEF DESCRIPTION OF THE DRAWINGS

These and other features and advantages of the present invention will become appreciated as the same becomes better understood with reference to the specification, claims and drawings wherein:

DESCRIPTION OF THE INVENTION

This invention is directed to a method of forming molded articles of bulk-solidifying amorphous alloys around the glass transition range, which preserves the high elastic limit of the bulk solidifying amorphous alloy upon the completion of molding process.

Figure 1:
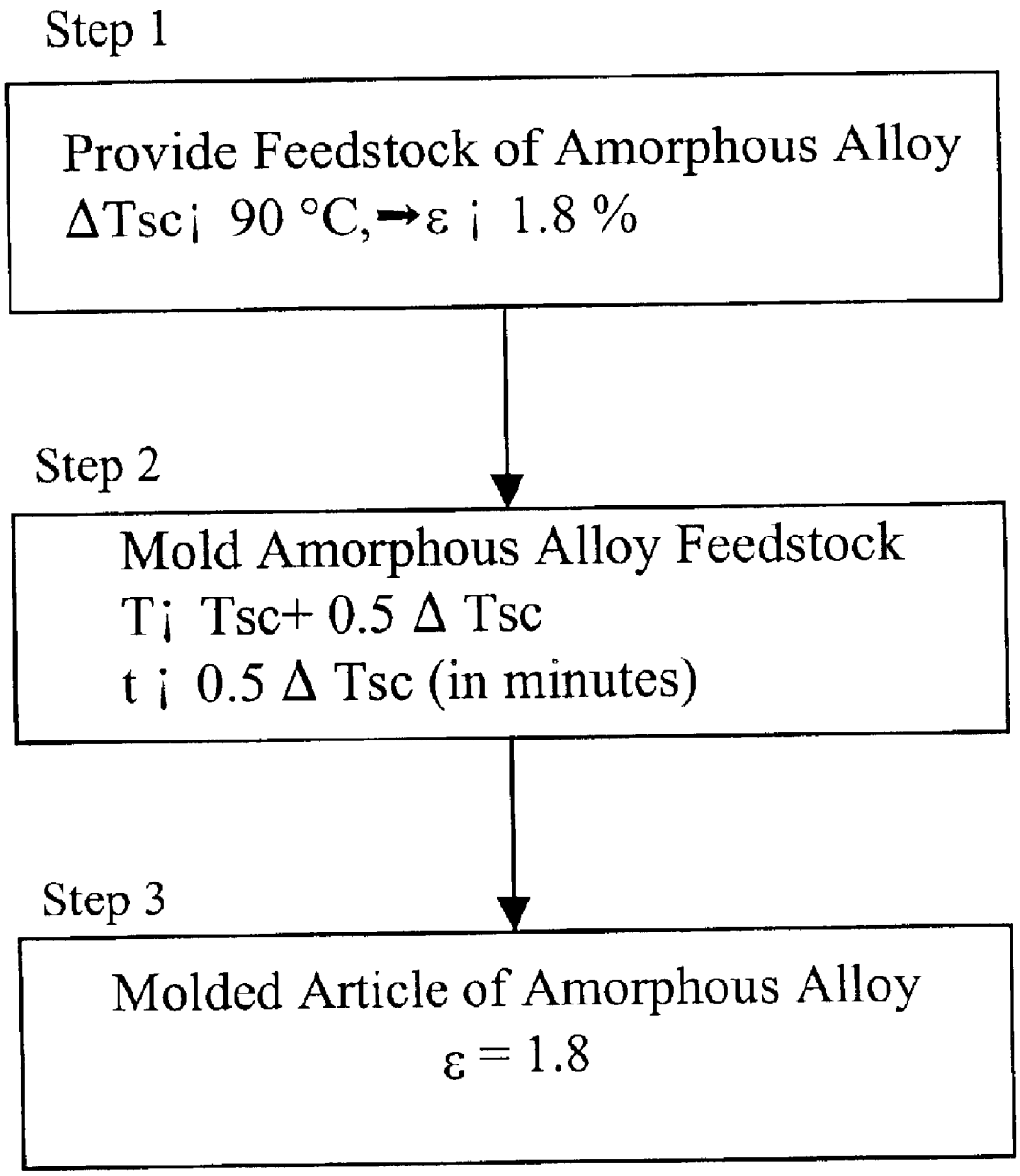
FIG. 1, is a flow diagram of a first exemplary method of forming molded articles of bulk-solidifying amorphous alloys according to the present invention.

In one embodiment of the invention, shown schematically in FIG. 1, a feedstock of bulk solidifying amorphous alloy is provided at Step 1. At Step 2, the provided feedstock of bulk solidifying amorphous alloy is molded around the glass transition range such that the final product maintains the high elastic limit of the bulk solidifying amorphous alloy feedstock. By controlling the time and temperature of the molding, upon the completion of forming process, at Step 3, the molded articles according to the current invention retains an elastic limit of at least 1.2%, and preferably an elastic limit of at least 1.8%, and most preferably an elastic limit of at least of 1.8% plus a bend ductility of at least 1.0%. Herein, the elastic limit is defined as the maximum level of strain beyond which permanent deformation or breakage sets in, where the percent is found by taking the ratio of the thickness (t) of a strip of the amorphous alloy and diameter (D) of the mandrel, according to the equation: e=t/D.

The feedstock of any suitable bulk-solidifying amorphous alloy can be prepared by any known casting process, including but not limited to continuous casting and metal mold casting process. The feedstock amorphous alloy may be in any suitable blank shape, such as sheets, plates, bars, cylindrical rods and as well as other shapes such as I-beams and pipes.

Figure 2:
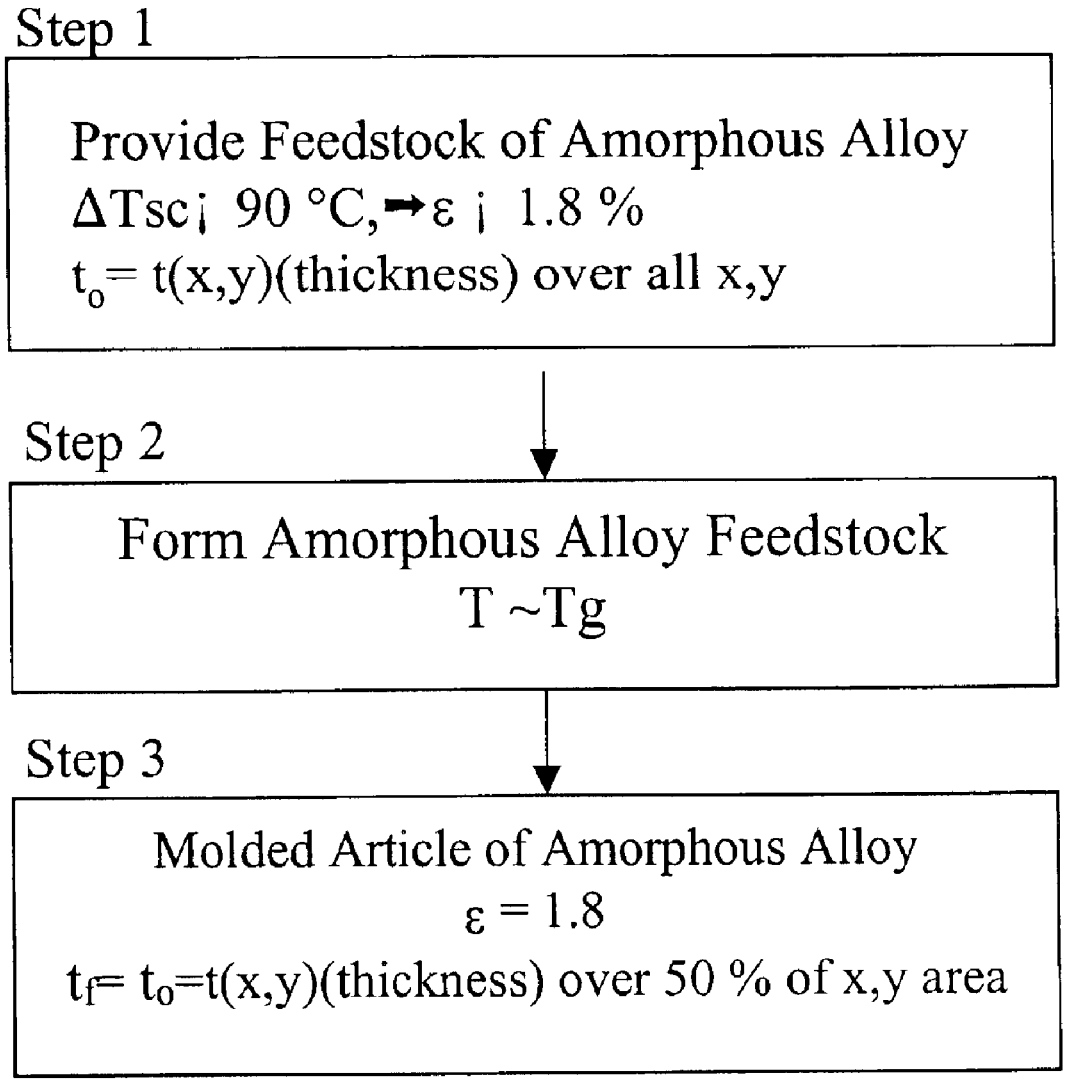
FIG. 2, is a flow diagram of a second exemplary method of forming molded articles of bulk-solidifying amorphous alloys according to the present invention.

FIG. 2 shows a second exemplary embodiment of a method of preserving the elastic limit of a bulk-solidifying amorphous allopy material in a molded article by further controlling the change in thickness of the feedstock. Although any suitable feedstock material and shape may be utilized in the present invention, preferably the feedstock is provided in a shape that allows the molding operation to be completed in the shortest time frame possible. Accordingly, in such an embodiment, the shape of the feedstock provided and subsequently the forming operation around the glass transition range is such that, the thickness of the feedstock is preserved over at least 20% of the surface area of the feedstock blank upon the completion of forming operation. Preferably, the thickness of the feedstock blank is preserved over at least 50% of its surface area, and still more preferably the thickness of the feedstock is preserved over at least 70% of its surface area, and most preferably the thickness of the feedstock is preserved over at least 90% of its surface area. In this embodiment the thickness of a feedstock blank is "preserved" when the thickness change is less than 10%, and preferably less than 5% and still more preferably less than 2% and most preferably the thickness remains substantially unchanged.

The "thickness of the feedstock" means the minimum dimension for the regular shaped feedstock. As such, thickness becomes the "diameter" for long cylindrical objects, or "diameter defining the cross section" for long polygonal objects, or "wall thickness" for pipes, or "height" for disc (pancake) shaped objects. "Thickness" can be more generally defined as the minimum possible dimension in the planar cross-sections of the feedstock object or minimum possible distance between opposing surfaces. The surface area will be then given by remaining two dimensions of feedstock object.

Figure 3A:
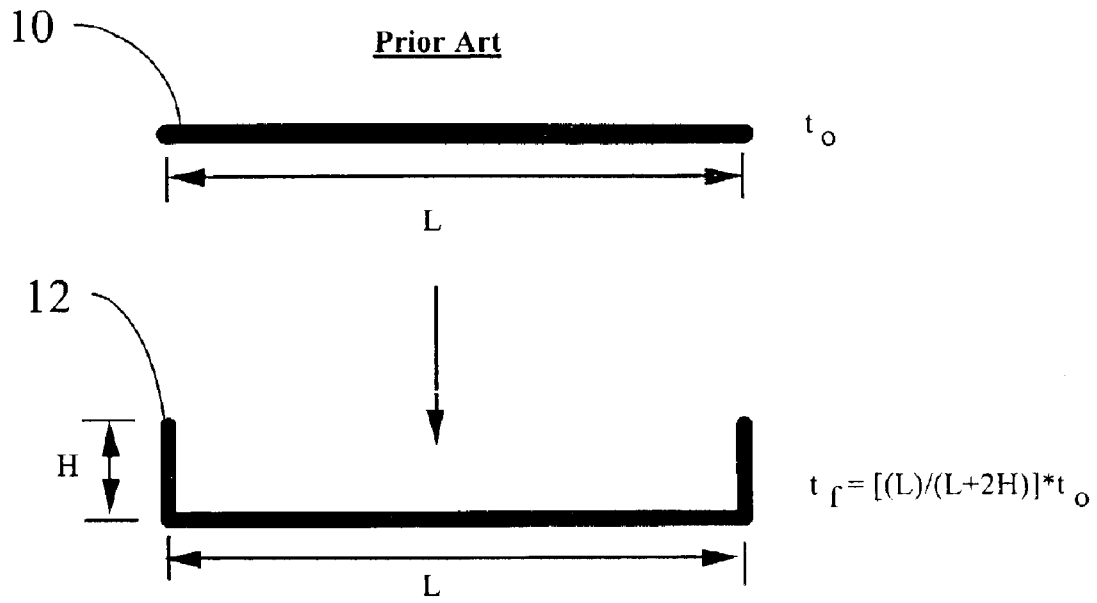
FIG. 3*a*, is a schematic of a prior art method of forming a molded article from a bulk-solidifying amorphous alloy.
Figure 3B:
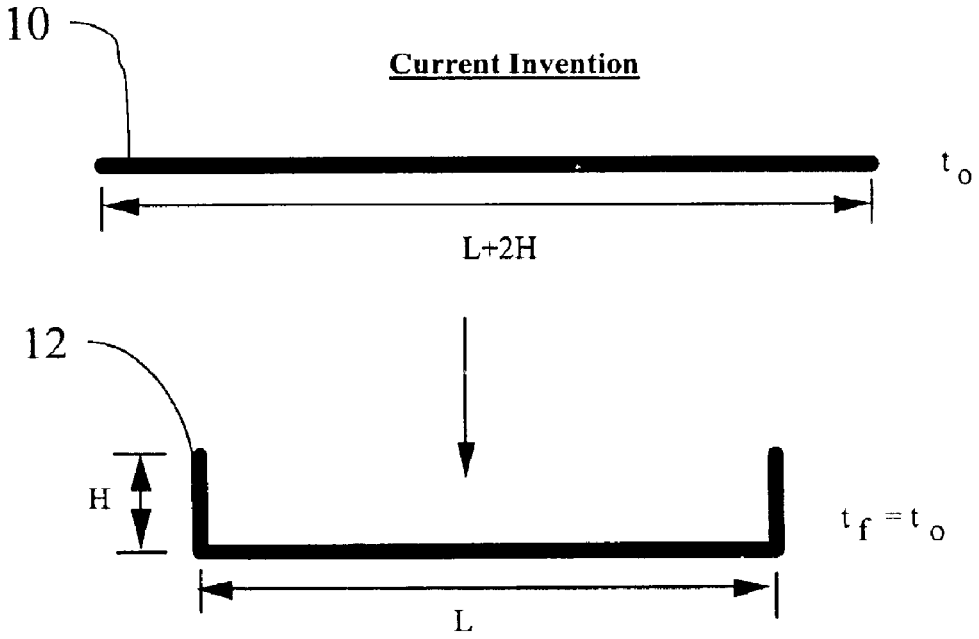
FIG. 3*b*, is a schematic of a method of forming a molded article from a bulk-solidifying amorphous alloy according to the present invention.

One example of current invention is illustrated schematically against the prior art as disclosed in U.S. Pat. No. 5,324,368, in FIGS. 3*a* and 3*b*. The prior art (FIG. 3*a*) requires deformation and thickness change over a majority of the surface area of the blank 10 as it is formed into the molded object 12, which slows down forming operation, requires extended time and much increased forming forces. Under these conditions, the preservation of high elastic of bulk-solidifying amorphous alloys becomes difficult. In the current invention (FIG. 3*b*), deformation and thickness change of the blank 10 occurs over a relatively limited surface area as it is formed into the molded object 12, which requires less time and much less forming forces. This teaching has two-fold ramifications: first it allows for the preservation of the elastic limit of the bulk-solidifying amorphous alloys upon molding; and second it allows for an increase in the speed of the molding operation, which effectively increases productivity and reduces cost.

Figure 4:
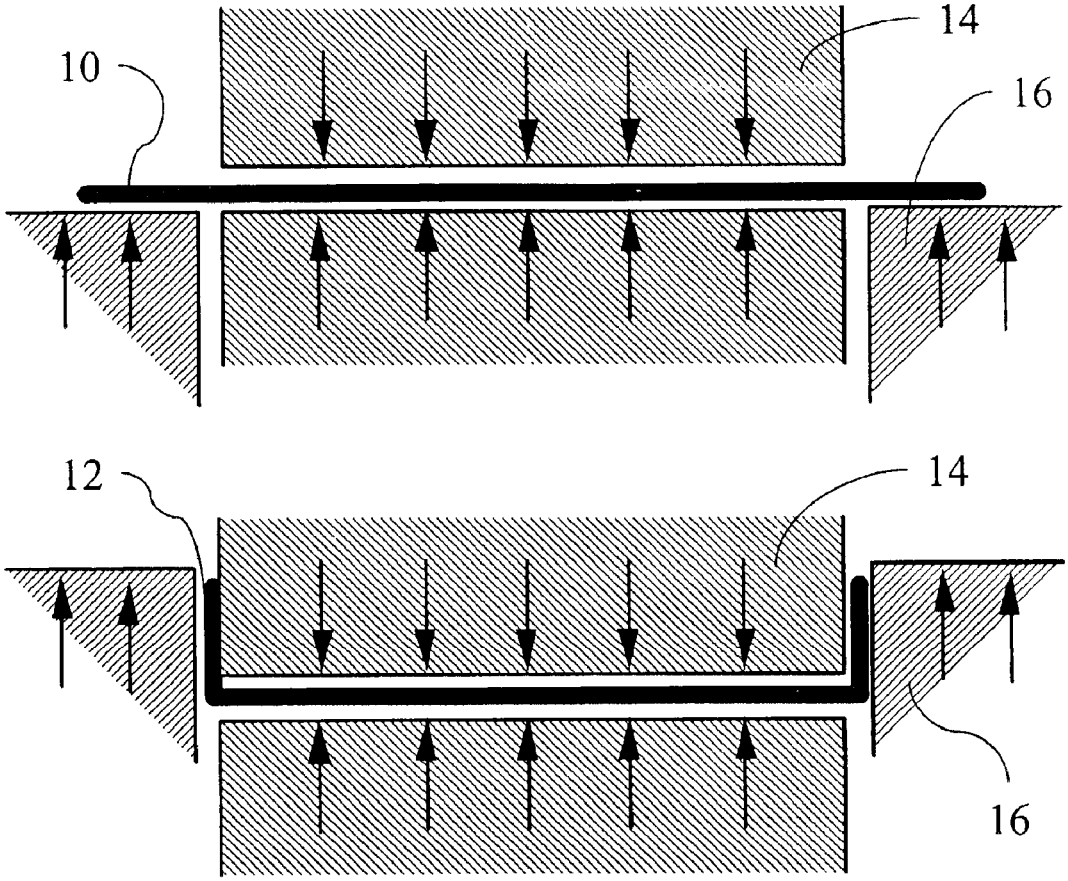
FIG. 4, is a schematic of a method of forming a molded article from a bulk-solidifying amorphous alloy according to the present invention.

Referring to FIG. 4, any suitable molding operation can be utilized to form molded articles 12 out of the amorphous alloy feedstock blank 10, die-forming (forcing feedstock material into a die cavity) and replication of surface features from a replicating die. For example, the forming process can be carried out with one piece of either the male or female die move relative to each other. However, the preferred method, shown schematically in FIG. 4 is where more than one piece of either or both of the male 14 and female 16 die moving relative to each other.

Although any suitable temperature may be used during the molding process, the amorphous alloy feedstock is preferably held around the glass transition range. In such an embodiment, "around the glass transition range" means, the forming operation can be carried out above the glass transition, slightly below the glass transition or at the glass transition, but is at least carried out below the crystallization temperature Tx. To ensure that the final molded product retains the high elastic limit of the amorphous alloy feedstock, the temperature and time of molding process is preferably restricted according to the temperature maximums shown in Table 1, below (temperature units are in ° C. and time units are minutes).

TABLE 1

Molding Temperature Restrictions

| ΔT | Tmax | Tmax (Pr.) | Tmax (M. Pr.) |
|---|---|---|---|
| ΔTsc > 90 | Tsc + 1/2 ΔTsc | Tsc + 1/4 ΔTsc | Tsc |
| 90 > ΔTsc > 60 | Tsc + 1/4 ΔTsc | Tsc | Tg |
| 60 > ΔTsc > 30 | Tsc | Tg | Tg-30 |

Where ΔTsc (supercooled liquid region) is the range in degrees over which the amorphous alloy is supercooled, Tmax is the maximum permissible temperature during the molding process, Tmax (Pr.) is the preferred maximum permissible temperature, and Tmax (M. Pr.) is the most preferred maximum permissible temperature during the molding process.

Figure 5:
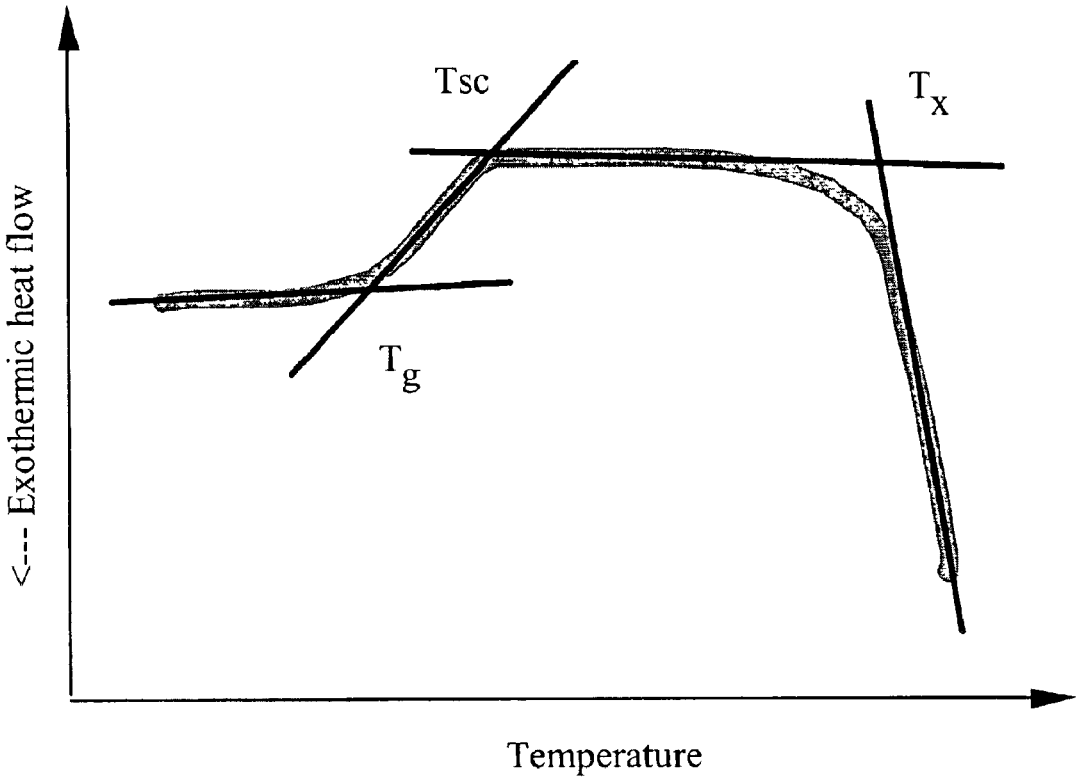
FIG. 5, is a graphical representation of the physical properties of the bulk-solidifying amorphous alloys according to the present invention.

In the above table and for the purposes of this disclosure, Tg, Tsc and Tx are determined from standard DSC (Differential Scanning Calorimetry) scans at 20° C./min as shown in FIG. 5. (Other heating rates such as 40° C./min, or 10° C./min can also be utilized while basic physics of this disclosure still remaining intact.) Tg is defined as the onset temperature of glass transition, Tsc is defined as the onset temperature of super-cooled liquid region, and Tx is defined as the onset temperature of crystallization. ΔTsc is defined as the difference between Tx and Tsc. All the temperature units are in ° C.

Accordingly, when ΔTsc of the feedstock amorphous alloy is more than 90° C., then the Tmax is given by (Tsc+½ ΔTsc), and preferably is given by (Tsc+¼ ΔTsc), and most preferably is given by Tsc. When ΔTsc of the feedstock amorphous alloy is more than 60° C., then the Tmax is given by (Tsc+¼ ΔTsc), and preferably is given by (Tsc), and most preferably is given by Tg. When ΔTsc of the feedstock amorphous alloy is more than 30° C., then the Tmax is given by Tsc, and preferably is given by (Tg), and most preferably is given by Tg−30.

Further, although any heating duration may be utilized in the current invention, the time that can be spent above certain temperatures is preferably limited and a summary of these preferred time restrictions is shown in Table 2, below.

TABLE 2

Molding Time Restrictions

| For ΔTsc > 90 | t(T > Tsc) | t(T > Tsc) (Pr.) | t(T > Tg-60) | t(T > Tg-60) (Pr.) |
|---|---|---|---|---|
| Tmax | .5 ΔTsc | .25 ΔTsc | 60 + 0.5 ΔTsc | 30 + .25 ΔTsc |
| Tmax (Pr.) | .5 ΔTsc | .25 ΔTsc | 60 + 0.5 ΔTsc | 30 + .25 ΔTsc |
| Tmax (M. Pr.) | 0 | 0 | 60 + 0.5 ΔTsc | 30 + .25 ΔTsc |
| **For 90 > ΔTsc > 60** | **t(T > Tsc)** | **t(T > Tsc) (Pr.)** | **t(T > Tg-60)** | **t(T > Tg-60) (Pr.)** |
| Tmax | .5 ΔTsc | .25 ΔTsc | 60 + 0.5 ΔTsc | 30 + .25 ΔTsc |
| Tmax (Pr.) | 0 | 0 | 60 + 0.5 ΔTsc | 30 + .25 ΔTsc |
| Tmax (M. Pr.) | 0 | 0 | 60 + 0.5 ΔTsc | 30 + .25 ΔTsc |
| **For 60 > ΔTsc > 30** | **t(T > Tg)** | **t(T > Tg) (Pr.)** | **t(T > Tg-60)** | **t(T > Tg-60) (Pr.)** |
| Tmax | 20 + 0.5 ΔTsc | 20 | 40 + 0.5 ΔTsc | 20 + 0.5 ΔTsc |
| Tmax (Pr.) | 0 | 0 | 40 + 0.5 ΔTsc | 20 + 0.5 ΔTsc |
| Tmax (M. Pr.) | 0 | 0 | 40 + 0.5 ΔTsc | 20 + 0.5 ΔTsc |

Accordingly, for a given Tmax, t(T>Tsc) defines the maximum permissible time that can be spent above the Tsc during the molding process, and t(T>Tsc) (Pr.) defines the preferred maximum permissible time. Further, for a given Tmax, t(T>Tg) defines the maximum permissible time that can be spent above the Tg during the molding process, and t(T>Tg) (Pr.) defines the preferred maximum permissible time. In addition to above conditions, for a given Tmax, t(T>Tg−60) defines the maximum permissible time that can be spent above the temperature (Tg−60)° C. during the molding process, and t(T>Tg−60) (Pr.) defines the preferred maximum permissible time. All the time values are given in minutes.

Further, the selection from the above described time and temperature windows can be tailored with the aid of the general crystallization behavior of is the bulk-solidifying amorphous alloy.

Figure 6A:
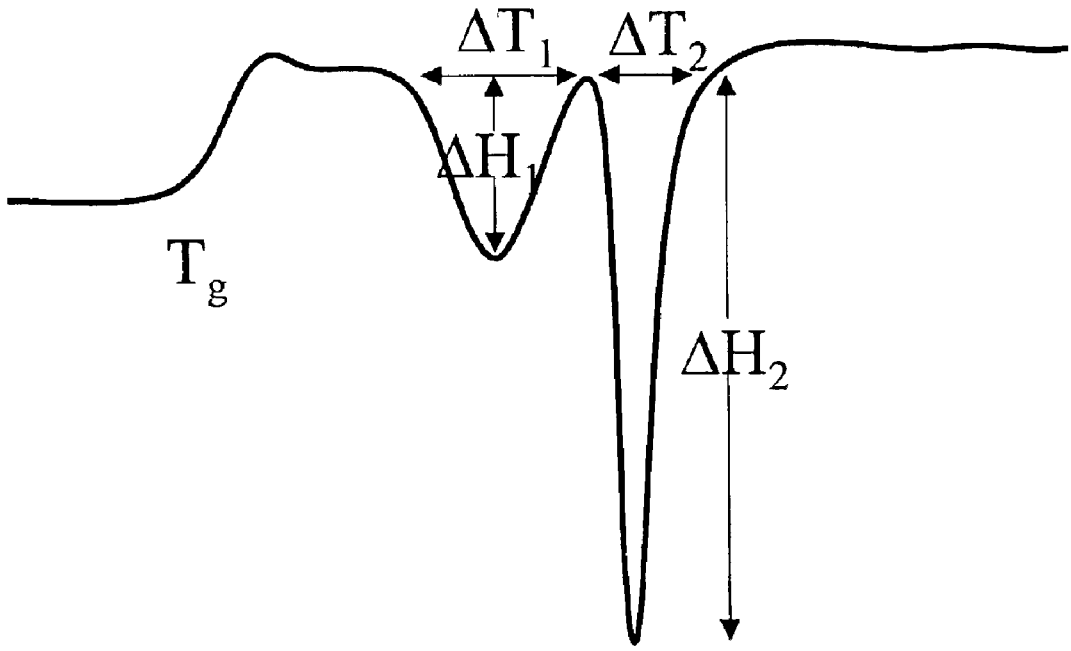
FIG. 6*a* is a graphical representation of the crystallization properties of the bulk-solidifying amorphous alloys according to the present invention.
Figure 6B:
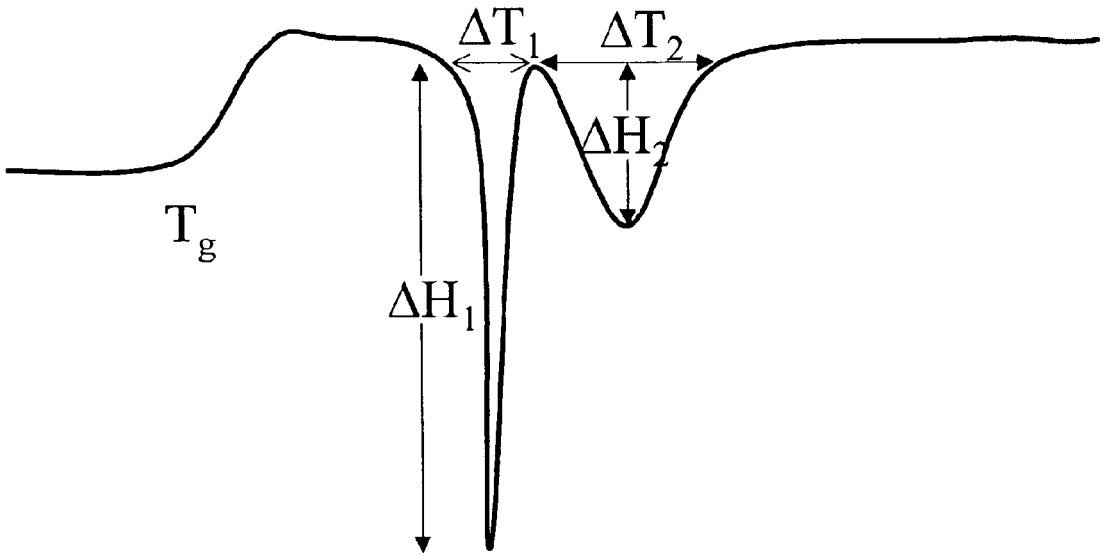
FIG. 6*b* is another graphical representation of the crystallization properties of the bulk-solidifying amorphous alloys according to the present invention.

For example, as shown in FIGS. 6*a* and 6*b*, in a typical DSC heating scan of bulk solidifying amorphous alloys, crystallization can take in one or more steps. The preferred bulk-solidifying amorphous alloys are ones with a single crystallization step in a typical DSC heating scan. However, most of the bulk solidifying amorphous alloys crystallizes in more than one step in a typical DSC heating scan. (For the purposes of this disclosure all the DSC heating scans are carried out at the rate of 20° C./min and all the extracted values are from DSC scans at 20° C./min. Other heating rates such as 40° C./min, or 10° C./min can also be utilized while basic physics of this disclosure still remaining intact)

Shown schematically in FIG. 6*a* is one type of crystallization behavior of a bulk-solidifying amorphous alloy in a typical DSC scan such as at 20° C./min heating rate. The crystallization happens to take place in two steps. As shown, in this example the first crystallization step occurs over a relatively large temperature range at a relatively slower peak transformation rate, whereas the second crystallization takes over a smaller temperature range and at a much faster peak transformation rate than the first one. Here ΔT1 and ΔT2 are defined as the temperature ranges where the first and second crystallization steps take over respectively. ΔT1 and ΔT2 can be calculated by taking the difference between the onset of the crystallization and "conclusion" of the crystallization, which are calculated in a similar manner for Tx by taking the cross section point of preceding and following trend lines as depicted in FIG. 5. The peak heat flow, ΔH1 and ΔH2, due to the enthalpy of crystallization can be calculated by calculating the peak heat flow value compared to the base-line heat flow. (It should be noted that although the absolute values of ΔT1, ΔT2, ΔH1 and ΔH2 depend on the specific DSC set-up and the size of the test specimens used, the relative scaling (i.e. ΔT1 vs ΔT2) should remain intact).

Shown schematically in FIG. 6*b* is a second embodiment of crystallization behavior of a bulk-solidifying amorphous alloy in a typical DSC scan, such as at the heating rate of 20° C./min. Again, the crystallization happens to take over in two steps, however, in this example the first crystallization step takes over a relatively small temperature range with a relatively faster peak transformation rate, whereas the second crystallization takes over a larger temperature range than the first one and at a much slower peak transformation rate than the first one. Here ΔT1, ΔT2, ΔH1 and ΔH2 are defined and calculated similarly as above.

Using the exemplary embodiments shown in FIGS. 6*a* and 6*b*, the bulk-solidifying amorphous alloy with the crystallization behavior shown in FIG. 6*b*, where ΔT1<ΔT2 and ΔH1>ΔH2, and which is the preferred alloy for more aggressive molding, i.e. for molding operations that require extensive deformation, higher maximum temperatures above glass transition temperatures, and longer duration. Higher temperatures above the glass transition provide improved fluidity and extended duration provides more time for homogeneous heating and deformation. For the case of the bulk-solidifying amorphous alloy shown in FIG. 6*a*, where ΔT1>ΔT2 and ΔH1<ΔH2, the more conservative time and temperature windows (described as "preferred" and "most preferred" maximum temperatures and time) are utilized.

In addition, a sharpness ratio can be defined for each crystallization step by ΔHn/ΔTn. The higher ΔH1/ΔT1 is compared to ΔHn/ΔTn, the more preferred the alloy composition is. Accordingly, from a given family of bulk solidifying amorphous alloys, the preferred composition is that material with the highest ΔH1/ΔT1 compared to other crystallization steps. For example, a preferred alloy composition has ΔH1/ΔT1>2.0*ΔH2/ΔT2. For these compositions more aggressive time and temperatures can be readily utilized in molding operations, i.e. t(T>Tsc) and Tmax (Pr.) rather than t(T>Tsc) (Pr.) and Tmax (M. Pr.). Still more preferable is ΔH1/ΔT1>4.0*ΔH2/ΔT2. For these compositions still more aggressive time and temperatures can be readily utilized in molding operations, i.e. t(T>Tsc) and Tmax rather than t(T>Tsc) (Pr.) and Tmax (Pr.). In contrast, for compositions where $\Delta H1/\Delta T1<0.5*\Delta H2/\Delta T2$, more conservative time and temperatures are preferable i.e. t(T>Tsc) (Pr.) and Tmax (M. Pr.) rather than t(T>Tsc) and Tmax (Pr.)

Although exemplary embodiments having only two crystallization steps are shown above, crystallization behavior of some bulk solidifying amorphous alloys can take place in more two steps. In such cases, the subsequent $\Delta T3$, $\Delta T4$, etc. and $\Delta H3$, $\Delta H4$, etc. can also be defined. In such cases, the preferred compositions of bulk amorphous alloys are ones where $\Delta H1$ is the largest of $\Delta H1$, $\Delta H2$, . . . $\Delta Hn$, and where $\Delta H1/\Delta T1$ is the larger from each of the subsequent $\Delta H2/\Delta T2$, . . . $\Delta Hn/\Delta Tn$.

Figure 7:
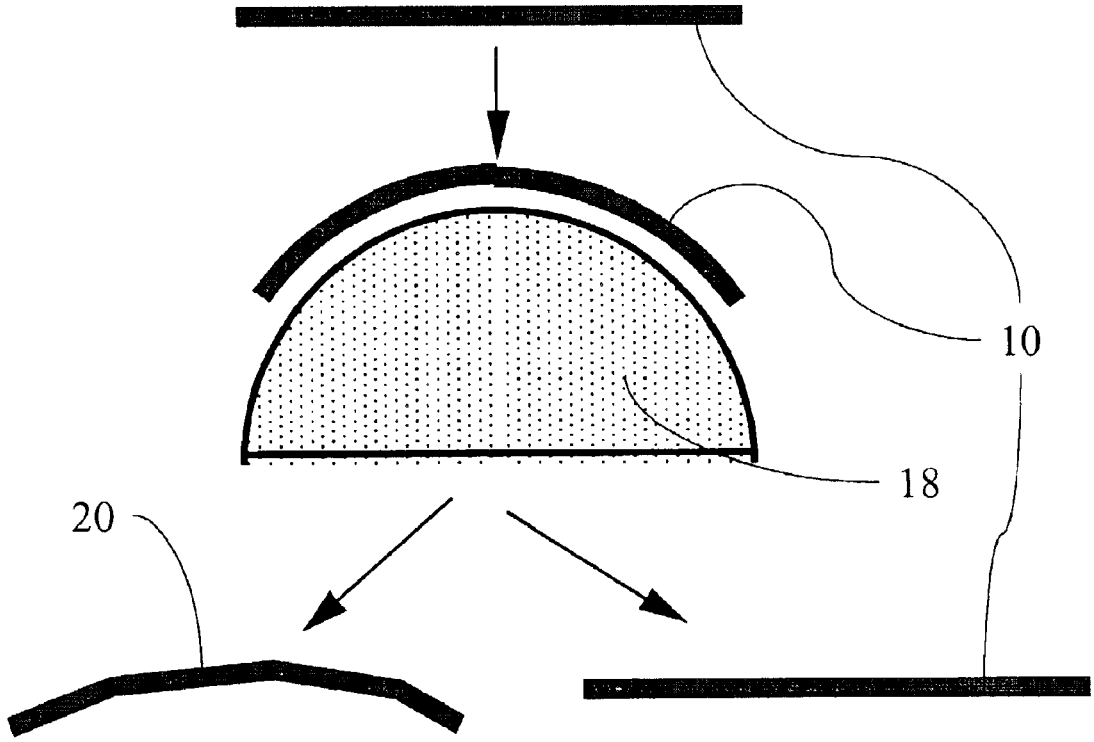
FIG. 7, is a schematic of a method of determining the elastic limit of a molded article according to the present invention.

When the molded article is finally formed, the elastic limit may be measured to ensure that the elastic limit is within the desired parameters. The elastic limit of an article can be measured by a variety of mechanical tests such as uni-axial tension test. However, this test may not be very practical. A relatively practical test is bending test, as shown schematically in FIG. 7, in which a cut strip of amorphous alloy 10, such as one with a thickness of 0.5 mm, is bent around mandrels 18 of varying diameter. After, the bending is complete and sample strip 10 is released, the sample 10 is said to stay elastic if no permanent bent is visibly observed. If a permanent bent can be visibly seen, the sample 20 is said to have exceeded its elastic limit strain. For a thin strip relative to the diameter of mandrel, the strain in this bending test is very closely given by ratio of thickness of strip (t) and diameter of mandrel (D), e=t/D.

Although any bulk-solidifying amorphous alloy may be utilized in the present invention, in a preferred embodiment the bulk-solidifying amorphous alloy has the capability of showing a glass transition and the feedstock made of such bulk-solidifying amorphous alloy an elastic limit of at least 1.5%. More preferably, the feedstock amorphous alloy has an elastic limit of at least 1.8%, and most preferably the feedstock amorphous alloy has an elastic limit of at least of 1.8% and a bend ductility of at least 1.0%. Further, the feedstock of bulk-solidifying amorphous alloy preferably has a ΔTsc (supercooled liquid region) of more than 30° C. as determined by DSC measurements at 20° C./min, and preferably a ΔTsc of more than 60° C., and still most preferably a ΔTsc of 90° C. or more. One suitable alloy having a ΔTsc of more than 90° C. is $Zr_{47}Ti_8Ni_{10}Cu_{7.5}Be_{27.5}$. U.S. Pat. Nos. 5,288,344; 5,368,659; 5,618,359; 5,032,196; and 5,735,975 (each of which are incorporated by reference herein) disclose families of such bulk solidifying amorphous alloys with ΔTsc of 30° C. or more. One such family of suitable bulk solidifying amorphous alloys may be described in general terms as $(Zr,Ti)_a(Ni,Cu,Fe)_b(Be,Al,Si,B)_c$, where a is in the range of from 30% to 75% of the total composition in atomic percentage, b is in the range of from 5% to 60% of the total composition in atomic percentage, and c is in the range of from 0% to 50% in total composition in atomic percentage.

Although the above-referenced alloys are suitable for use with the current invention, it should be understood that the alloys might accommodate substantial amounts of other transition metals up to 20% of the total composition in atomic percentage, and more preferably metals such as Nb, Cr, V, Co. An example of a suitable alloy incorporating these transition metals includes the alloy family $(Zr,Ti)_a(Ni,Cu)_b(Be)_c$, wherein a is in the range of from 40% to 75% total composition in atomic percentage, b is in the range of from 5% to 50% total composition in atomic percentage, and c is in the range of from 5% to 50% total composition in atomic percentage.

Still, a more preferable alloy family is $(Zr,Ti)_a(Ni,Cu)_b(Be)_c$, wherein a is in the range of from 45% to 65% total composition in atomic percentage, b is in the range of from 10% to 40% total composition in atomic percentage, and c is in the range of from 5% to 35% total composition in atomic percentage, and the ratio of Ti/Zr is in the range of from 0 to 0.25. Another preferable alloy family is $(Zr)_a(Ti,Nb)_b(Ni,Cu)_c(Al)_d$ wherein a is in the range of from 45% to 70% total composition in atomic percentage, b is in the range of from 0% to 10% total composition in atomic percentage, c is in the range of from 10% to 45% total composition in atomic percentage, and d is in the range of from 5% to 25% total composition in atomic percentage.

Another set of bulk-solidifying amorphous alloys are ferrous metals (Fe, Ni, Co) based compositions. Examples of such compositions are disclosed in U.S. Pat. No. 6,325,868, (A. Inoue et. al., Appl. Phys. Lett., Volume 71, p 464 (1997)), (Shen et. al., Mater. Trans., JIM, Volume 42, p 2136 (2001)), and Japanese patent application 2000126277 (Publ. # .2001303218 A), the disclosures of which are incorporated herein by reference. One exemplary composition of such alloys is $Fe_{72}Al_5Ga_2P_{11}C_6B_4$. Another exemplary composition of such alloys is $Fe_{72}Al_7Zr_{10}Mo_5W_2B_{15}$. Although, these alloy compositions are not processable to the degree of Zr-base alloy systems, they can be still be processed in thicknesses around 1.0 mm or more, sufficient enough to be utilized in the current disclosure. Although their density is generally higher than Zr/Ti-base alloys, from 6.5 g.cc to 8.5 g/cc, their hardness is also higher, from 7.5 GPA to 12 GPa or more making them particularly attractive. Similarly, they have elastic strain limit higher than 1.2% and very high yield strengths from 2.5 GPa to 4 GPa.

In general, crystalline precipitates in bulk amorphous alloys are highly detrimental to their properties, especially to the toughness and strength, and as such generally preferred to a minimum volume fraction possible. However, there are cases in which, duc crystalline phases precipitate in-situ during the processing of bulk amorphous alloys, which are indeed beneficial to the properties of bulk amorphous alloys especially to the toughness and ductility. Such bulk amorphous alloys comprising such beneficial precipitates are also included in the current invention. One exemplary case is disclosed in (C. C. Hays et. al, Physical Review Letters, Vol. 84, p 2901, 2000).

While several forms of the present invention have been illustrated and described, it will be apparent to those of ordinary skill in the art that various modifications and improvements can be made without departing from the spirit and scope of the invention. Accordingly, it is not intended that the invention be e limited, except as by the appended claims.

What is claimed is:

1. A method of forming molded articles having high elastic limits comprising:

providing a feedstock of bulk-solidifying amorphous alloy having a glass transition ($T_g$), a supercooled temperature ($T_{sc}$), and a crystallization temperature ($T_x$), where the difference between $T_{sc}$ and $T_x$ defines a supercooled temperature region (ΔTsc);

heating the feedstock to a molding temperature molding the feedstock for a time less than a specified maximum permissible molding time at temperatures less than a specified maximum molding temperature around the glass transition temperature of the feedstock to form a molded article such that the molded article retains an elastic limit of at least 1.2%, wherein the maximum molding temperature is proportional to the size of the ΔTsc and wherein the specified permissible molding time is proportional to both the molding temperature and the ΔTsc; and wherein the ΔTsc of the feedstock is more than 90° C., and the maximum molding temperature is given by a value selected from the group consisting of (Tsc+½ ΔTsc), (Tsc+¼ ΔTsc), and Tsc.

2. The method according to claim 1, wherein the ΔTsc of the feedstock is more than 90° C. and the maximum molding temperature is given by either the equation: (Tsc+½ ΔTsc) or by the equation (Tsc+¼ ΔTsc , and the maximum molding time, in minutes, at which the temperature of the feedstock is held above Tsc is given by a value selected from the group consisting of 0.5·ΔTsc and 0.25·ΔTsc.

3. The method according to claim 1, wherein the ΔTsc of the feedstock is more than 90° C. and the maximum molding temperature is given by any of the equations selected from the group consisting of: (Tsc+½ ΔTsc), (Tsc+¼ ΔTsc), and (Tsc), and the maximum molding time, in minutes, at which the temperature of the feedstock is held above Tg−60° C. Tsc is given by a value selected from the group consisting of 60+0.5·ΔTsc, and 30+0.25·ΔTsc.

4. A method of forming molded articles having high elastic limits comprising:

providing a feedstock of bulk-solidifying amorphous alloy having a glass transition ($T_g$), a supercooled temperature ($T_{sc}$), and a crystallization temperature ($T_x$), where the difference between $T_{sc}$ and $T_x$ defines a supercooled temperature region (ΔTsc);

heating the feedstock to a molding temperature molding the feedstock for a time less than a specified maximum permissible molding time at temperatures less than a specified maximum molding temperature around the glass transition temperature of the feedstock to form a molded article such that the molded article retains an elastic limit of at least 1.2%, wherein the maximum molding temperature is proportional to the size of the ΔTsc and wherein the specified permissible molding time is proportional to both the molding temperature and the ΔTsc; and wherein the ΔTsc of the feedstock is more than 60° C. and less than 90° C., and the maximum molding is given by a value selected from the group consisting of (Tsc+¼ ΔTsc), Tsc, and Tg.

5. The method according to claim 4, wherein the ΔTsc of the feedstock is more than 60° C. and less than 90° C. and the maximum molding temperature is given by the equation: (Tsc+¼ ΔTsc), and the maximum molding time, in minutes, at which the temperature of the feedstock is held above Tsc is given by a value selected from the group consisting of 0.5·ΔTsc, and 0.25·ΔTsc.

6. The method according to claim 4, wherein the ΔTsc of the feedstock is more than 60° C. and less than 90° C. and the maximum molding temperature is given by any of the equations selected from the group consisting of: (Tsc+¼ ΔTsc), (Tsc), and (Tg), and the maximum molding time, in minutes, at which the temperature of the feedstock is held above Tg−60° C. is given by a value selected from the group consisting of 60+0.5·ΔTsc, and 30+0.25·ΔTsc.

7. A method of forming molded articles having high elastic limits comprising:

providing a feedstock of bulk-solidifying amorphous alloy having a glass transition ($T_g$), a supercooled temperature ($T_{sc}$), and a crystallization temperature ($T_x$), where the difference between $T_{sc}$ and $T_x$ defines a supercooled temperature region (ΔTsc);

heating the feedstock to a molding temperature molding the feedstock for a time less than a specified maximum permissible molding time at temperatures less than a specified maximum molding temperature around the glass transition temperature of the feedstock to form a molded article such that the molded article retains an elastic limit of at least 1.2%, wherein the maximum molding temperature is proportional to the size of the ΔTsc and wherein the specified permissible molding time is proportional to both the molding temperature and the ΔTsc; and wherein the ΔTsc of the feedstock is more than 30° C. and less than 60° C., and the maximum molding is given by a value selected from the group consisting of Tsc, Tg, and Tg−30.

8. The method according to claim 7, wherein the ΔTsc of the feedstock is more than 30° C. and less than 60° C. and the maximum molding temperature is given by the quantity: (Tsc), and the maximum molding time, in minutes, at which the temperature of the feedstock is held above Tsc Tsc is given by a value selected from the group consisting of 20+0.5·ΔTsc, and 20.

9. The method according to claim 7, wherein the ΔTsc of the feedstock is more than 30° C. and less than 60° C. and the maximum molding temperature is given by any of the equations selected from the group consisting of: (Tsc), (Tg), and (Tg−30), and the maximum molding time at which the temperature of the feedstock is held above Tg−60° C. Tsc is given by a value selected from the group consisting of 40+0.5·ΔTsc, and 20+0.5·ΔTsc.

10. A method of forming molded articles having high elastic limits comprising:

providing a feedstock of bulk-solidifying amorphous alloy having a glass transition ($T_g$), a supercooled temperature ($T_{sc}$), and a crystallization temperature ($T_x$), where the difference between $T_{sc}$ and $T_x$ defines a supercooled temperature region (ΔTsc);

heating the feedstock to a molding temperature molding the feedstock for a time less than a specified maximum permissible molding time at temperatures less than a specified maximum molding temperature around the glass transition temperature of the feedstock to form a molded article such that the molded article retains an elastic limit of at least 1.2%, wherein the maximum molding temperature is proportional to the size of the ΔTsc and wherein the specified permissible molding time is proportional to both the molding temperature and the ΔTsc; and wherein the bulk solidifying amorphous alloy has at least two different crystallization steps which define at least two temperature ranges (ΔT1 and ΔT2) over which crystallization occurs and at least two peak heat flows (ΔH1 an ΔH2) and wherein the composition of the bulk solidifying amorphous alloy is selected such that the ΔH1 is larger from each of the subsequent enthalpies of crystallization and ΔH1/ΔT1>2.0·ΔH2/ΔT2.

11. The method according to claim 10, wherein the ΔTsc of the feedstock is more than 90° C., and the maximum molding temperature is given by (Tsc+¼ ΔTsc).

12. The method according to claim 10, wherein the ΔTsc of the feedstock is more than 60° C. and less than 90° C., and the maximum molding temperature is given by (Tsc).

13. The method according to claim 10, wherein the ΔTsc of the feedstock is more than 30° C. and less than 60° C., and the maximum molding temperature is given by (Tg).

14. The method according to claim 10, wherein the composition of the bulk solidifying amorphous alloy is selected such that the ΔH1 is larger from each of the subsequent enthalpies of crystallization and ΔH1/ΔT1>4.0·ΔH2/ΔT2.

15. The method according to claim 14, wherein the ΔTsc of the feedstock is more than 90° C., and the maximum molding temperature is given by (Tsc+½ ΔTsc).

16. The method according to claim 14, wherein the ΔTsc of the feedstock is more than 60° C. and less than 90° C., and the maximum molding temperature is given by (Tsc+¼ ΔTsc).

17. The method according to claim 14, wherein the ΔTsc of the feedstock is more than 30° C. and less than 60° C., and the maximum molding temperature is given by (Tsc).

18. A method of forming molded articles having high elastic limits comprising:

providing a feedstock of bulk-solidifying amorphous alloy having a glass transition ($T_g$), a supercooled temperature ($T_{sc}$), and a crystallization temperature ($T_x$), where the difference between $T_{sc}$ and $T_x$ defines a supercooled temperature region (ΔTsc);

heating the feedstock to a molding temperature molding the feedstock for a time less than a specified maximum permissible molding time at temperatures less than a specified maximum molding temperature around the glass transition temperature of the feedstock to form a molded article such that the molded article retains an elastic limit of at least 1.2%, wherein the maximum molding temperature is proportional to the size of the ΔTsc and wherein the specified permissible molding time is proportional to both the molding temperature and the ΔTsc; and wherein the bulk solidifying amorphous alloy has at least two different crystallization steps which define at least two temperature ranges (ΔT1 and ΔT2) over which crystallization occurs and at least two peak heat flows (ΔH1 an ΔH2) and wherein ΔH1/ΔT1>0.5·ΔH2/ΔT2 and the ΔTsc of the feedstock is more than 90° C., then the maximum molding temperature is given by (Tsc).

19. A method of forming molded articles having high elastic limits comprising:

providing a feedstock of bulk-solidifying amorphous alloy having a glass transition ($T_g$), a supercooled temperature ($T_{sc}$), and a crystallization temperature ($T_x$), where the difference between $T_{sc}$ and $T_x$ defines a supercooled temperature region (ΔTsc);

heating the feedstock to a molding temperature molding the feedstock for a time less than a specified maximum permissible molding time at temperatures less than a specified maximum molding temperature around the glass transition temperature of the feedstock to form a molded article such that the molded article retains an elastic limit of at least 1.2%, wherein the maximum molding temperature is proportional to the size of the ΔTsc and wherein the specified permissible molding time is proportional to both the molding temperature and the ΔTsc; and wherein the bulk solidifying amorphous alloy has at least two different crystallization steps which define at least two temperature ranges (ΔT1 and ΔT2) over which crystallization occurs and at least enthalpies of crystallization (ΔH1 and ΔH2) and wherein ΔH1/ΔT1>0.5·ΔH2/ΔT2 and the $\Delta T_{sc}$ of the feedstock is more than 60° C. and less than 90° C., then the maximum molding temperature is given by (Tg).

20. A method of forming molded articles having high elastic limits comprising:

providing a feedstock of bulk-solidifying amorphous alloy having a glass transition ($T_g$), a supercooled temperature ($T_{sc}$), and a crystallization temperature ($T_x$), where the difference between $T_{sc}$ and $T_x$ defines a supercooled temperature region (ΔTsc);

heating the feedstock to a molding temperature molding the feedstock for a time less than a specified maximum permissible molding time at temperatures less than a specified maximum molding temperature around the glass transition temperature of the feedstock to form a molded article such that the molded article retains an elastic limit of at least 1.2%, wherein the maximum molding temperature is proportional to the size of the ΔTsc and wherein the specified permissible molding time is proportional to both the molding temperature and the ΔTsc; and wherein the bulk solidifying amorphous alloy has at least two different crystallization steps which define at least two temperature ranges (ΔT1 and ΔT2) over which crystallization occurs and at least two peak heat flows (ΔH1 an ΔH2) and wherein ΔH1/ΔT1>0.5·ΔH2/ΔT2 and the ΔTsc of the feedstock is more than 30*C. and less than 60° C., then the maximum molding temperature is given by (Tg−30).

21. A method of forming molded articles having high elastic limits comprising:

providing a feedstock of bulk-solidifying amorphous alloy having a thickness;

heating the feedstock to a molding temperature molding the feedstock for a time less than a maximum specified permissible molding time at temperatures less than a specified maximum molding temperature around the glass transition temperature of the feedstock to form a molded article, wherein the thickness of the feedstock is sufficiently preserved over at least 20% of the surface area of the feedstock such that the molded article retains an elastic limit of at least 1.2%; and wherein the bulk solidifying amorphous alloy has at least two different crystallization steps which define at least two temperature ranges (ΔT1 and ΔT2) over which crystallization occurs and at least two peak heat flows (ΔH1 an ΔH2) and wherein the composition of the bulk solidifying amorphous alloy is selected such that the ΔH1 is larger from each of the subsequent enthalpies of crystallization and ΔH1/ΔT1>2.0·ΔH2/ΔT2.

22. A method of forming molded articles having high elastic limits comprising:

providing a feedstock of bulk-solidifying amorphous alloy having a thickness;

heating the feedstock to a molding temperature molding the feedstock for a time less than a maximum specified permissible molding time at temperatures less than a specified maximum molding temperature around the glass transition temperature of the feedstock to form a molded article, wherein the thickness of the feedstock is sufficiently preserved over at least 20% of the surface area of the feedstock such that the molded article retains an elastic limit of at least 1.2%; and wherein the bulk solidifying amorphous alloy has at least two different crystallization steps which define at least two temperature ranges (ΔT1 and ΔT2) over which crystallization occurs and at least two peak heat flows (ΔH1 an ΔH2) and wherein the composition of the bulk solidifying amorphous alloy is selected such that the ΔH1 is larger from each of the subsequent enthalpies of crystallization and ΔH1/ΔT1>4.0·ΔH2/ΔT2.

23. A method of forming molded articles having high elastic limits comprising:

providing a feedstock of bulk-solidifying amorphous alloy having a glass transition ($T_g$), a supercooled temperature ($T_{sc}$), and a crystallization temperature ($T_x$), where the difference between $T_{sc}$ and $T_x$ defines a supercooled temperature region (ΔTsc);

heating the feedstock to a molding temperature molding the feedstock for a time less than a specified maximum permissible molding time at temperatures less than a specified maximum molding temperature around the glass transition temperature of the feedstock to form a molded article such that the molded article retains an elastic limit of at least 1.2%, wherein the maximum molding temperature is proportional to the size of the ΔTsc and wherein the specified permissible molding time is proportional to both the molding temperature and the ΔTsc wherein the bulk-solidifying amorphous alloy has at least two different crystallization steps which define at least two temperature ranges (ΔT1 and ΔT2) over which crystallization occurs and at least two peak heat flows (ΔH1 and ΔH2), such that where **ΔH1/ΔT1>2.0*ΔH2/ΔT2** then where ΔTsc is more than 90° C. then the maximum molding temperature is given by Tsc+¼ ΔTsc and the maximum molding time in minutes is given by 0.25 ΔTsc, where ΔTsc is more than 60° C. and less than 90° C. then the maximum molding temperature is given by Tsc and the maximum molding time in minutes is given by 0.25 ΔTsc, and where ΔTsc is more than 30° C. and less than 60° C. then the maximum molding temperature is given by Tg and the maximum molding time in minutes is given by 20.

24. A method of forming molded articles having high elastic limits comprising:

providing a feedstock of bulk-solidifying amorphous alloy having a glass transition ($T_g$), a supercooled temperature ($T_{sc}$), and a crystallization temperature ($T_x$), where the difference between $T_{sc}$ and $T_x$ defines a supercooled temperature region (ΔTsc);

heating the feedstock to a molding temperature molding the feedstock for a time less than a specified maximum permissible molding time at temperatures less than a specified maximum molding temperature around the glass transition temperature of the feedstock to form a molded article such that the molded article retains an elastic limit of at least 1.2%, wherein the maximum molding temperature is proportional to the size of the ΔTsc and wherein the specified permissible molding time is proportional to both the molding temperature and the ΔTsc wherein the bulk-solidifying amorphous alloy has at least two different crystallization steps which define at least two temperature ranges (ΔT1 and ΔT2) over which crystallization occurs at least two peak heat flows (ΔH1 and ΔH2), such that where **ΔH1/ΔT1>4.0*ΔH2/ΔT2** then where ΔTsc is more than 90° C. then the maximum molding temperature is given by Tsc+½ ΔTsc and the maximum molding time in minutes is given by 0.5 ΔTsc, where ΔTsc is more than 60° C. and less than 90° C. then the maximum molding temperature is given by Tsc+¼ ΔTsc and the maximum molding time in minutes is given by 0.5 ΔTsc, and where ΔTsc is more than 30° C. and less than 60° C. then the maximum molding temperature is given by Tsc and the maximum molding time in minutes is given by 20+5 ΔTsc.

25. A method of forming molded articles having high elastic limits comprising:

providing a feedstock of bulk-solidifying amorphous alloy having a glass transition ($T_g$), a supercooled temperature ($T_{sc}$), and a crystallization temperature ($T_x$), where the difference between $T_{sc}$ and $T_x$ defines a supercooled temperature region (ΔTsc);

heating the feedstock to a molding temperature molding the feedstock for a time less than a specified maximum permissible molding time at temperatures less than a specified maximum molding temperature around the glass transition temperature of the feedstock to form a molded article such that the molded article retains an elastic limit of at least 1.2%, wherein the maximum molding temperature is proportional to the size of the ΔTsc and wherein the specified permissible molding time is proportional to both the molding temperature and the ΔTsc wherein the bulk-solidifying amorphous alloy has at least two different crystallization steps which define at least two temperature ranges (ΔT1 and ΔT2) over which crystallization occurs and at two peak heat flows (ΔH1 and ΔH2), such that where **ΔH1/ΔT1<0.5*ΔH2/ΔT2** then where ΔTsc is more than 90° C. then the maximum molding temperature is given by Tsc and the maximum molding time in minutes is given by 0.25 ΔTsc, where ΔTsc is more than 60° C. and less than 90° C. then the maximum molding temperature is given by Tg and the maximum molding time in minutes is given by 0.25 ΔTsc, and where ΔTsc is more than 30° C. and less than 60° C. then the maximum molding temperature is given by Tg and the maximum molding time in minutes is given by 20.

* * * * *